US011401792B2

(12) United States Patent
Mollatt

(10) Patent No.: US 11,401,792 B2
(45) Date of Patent: Aug. 2, 2022

(54) DUAL-PRESSURE BOOSTING LIQUID PARTITION DEVICE, SYSTEM , FLEET AND USE

(71) Applicant: RSM Imagineering AS, Trollasen (NO)

(72) Inventor: Torbjorn Mollatt, Trollasen (NO)

(73) Assignee: RSM Imagineering AS, Trollåsen (NO)

( * ) Notice: Subject to any disclaimer, the term of this patent is extended or adjusted under 35 U.S.C. 154(b) by 439 days.

(21) Appl. No.: 16/628,034

(22) PCT Filed: Jun. 27, 2018

(86) PCT No.: PCT/EP2018/067230
§ 371 (c)(1),
(2) Date: Jan. 2, 2020

(87) PCT Pub. No.: WO2019/007774
PCT Pub. Date: Jan. 10, 2019

(65) Prior Publication Data

US 2020/0217186 A1 Jul. 9, 2020

(30) Foreign Application Priority Data

Jul. 4, 2017 (NO) ..... 20171100

(51) Int. Cl.
*E21B 43/26* (2006.01)
*F04B 53/10* (2006.01)
(Continued)

(52) U.S. Cl.
CPC ..... *E21B 43/26* (2013.01); *F04B 5/02* (2013.01); *F04B 19/04* (2013.01); *F04B 45/02* (2013.01);
(Continued)

(58) Field of Classification Search
CPC ..... E21B 43/26; E21B 43/267; F04B 19/04; F04B 53/10; F04B 9/105; F04B 43/026;
(Continued)

(56) References Cited

U.S. PATENT DOCUMENTS 1,660,302 A 2/1928 Shafer
1,820,236 A 11/1928 Loud
(Continued)

FOREIGN PATENT DOCUMENTS

EP 2913525 9/2015
EP 2913525 A1 * 9/2015 ..... F04B 1/02

*Primary Examiner* — Dominick L Plakkoottam
(74) *Attorney, Agent, or Firm* — Christian D. Abel

(57) ABSTRACT

A dual acting pressure boosting liquid partition device (2) and system, including a hollow cylinder housing (20) having a longitudinal extension, the cylinder housing (20) having at least a first part and a second part having a first transverse cross sectional area (a1) and a third part having a second transverse cross sectional area (a2) of different size than the first transverse cross sectional area (a1), a rod having a cross sectional area corresponding to the first transverse cross sectional area (a1), the rod further having a protruding portion (30) having a cross sectional area corresponding to the second transverse cross sectional area (a2), and the protruding portion and the third part of the cylinder housing (20) defining a first outer chamber (44') and a second outer chamber (44").

11 Claims, 2 Drawing Sheets

(51) Int. Cl.

| | |
|---|---|
| ***F04B 19/04*** | (2006.01) |
| ***F04B 5/02*** | (2006.01) |
| ***F04B 45/02*** | (2006.01) |
| *F04B 9/105* | (2006.01) |
| *F04B 43/02* | (2006.01) |
| *F04B 43/113* | (2006.01) |
| *F04B 53/14* | (2006.01) |

(52) U.S. Cl.
CPC ..... *F04B 9/105* (2013.01); *F04B 43/026* (2013.01); *F04B 43/1136* (2013.01); *F04B 53/10* (2013.01); *F04B 53/14* (2013.01)

(58) Field of Classification Search
CPC ..... F04B 43/1136; F04B 53/14; F04B 5/02; F04B 15/02; F04B 43/0054; F04B 45/033; F04B 47/00; F04B 43/10; F04B 1/02; F04B 19/22; F04B 2201/0201; F04B 43/0072; F04B 43/06; F04B 43/086; F04B 45/02; F04B 45/022; F04B 37/12; F04B 43/08; F04B 45/053; F04B 9/113
See application file for complete search history.

(56) References Cited

U.S. PATENT DOCUMENTS

| | | | | |
|---|---|---|---|---|
| 2,427,616 | A | 10/1944 | Mohler | |
| 3,920,552 | A | 11/1975 | Elkern | |
| 5,279,504 | A | 1/1994 | Williams | |
| 5,308,230 | A * | 5/1994 | Moore | F04B 43/1136 417/394 |
| 5,324,175 | A | 6/1994 | Sorensen | |
| 5,613,420 | A | 3/1997 | Glockemann | |
| 11,268,502 | B2 * | 3/2022 | Mollatt | F04B 43/1136 |
| 11,286,920 | B2 * | 3/2022 | Mollatt | F04B 49/10 |
| 2007/0012805 | A1 | 6/2007 | Stamper | |
| 2007/0028674 | A1 | 12/2007 | Chance | |
| 2011/0189029 | A1 * | 8/2011 | Van De Velde | F04B 43/086 417/307 |
| 2014/0079573 | A1 * | 3/2014 | Pabst | F04B 7/02 417/443 |
| 2015/0252661 | A1 | 9/2015 | Glass | |
| 2017/0292358 | A1 * | 10/2017 | Elish | F04B 9/115 |
| 2018/0135606 | A1 * | 5/2018 | Oklejas, Jr. | F04B 49/22 |

* cited by examiner

DUAL-PRESSURE BOOSTING LIQUID PARTITION DEVICE, SYSTEM , FLEET AND USE

The invention relates to a dual acting pressure boosting liquid partition device for a closed hydraulic loop volume, a system comprising the dual acting pressure boosting liquid partition device for a closed hydraulic loop volume the dual acting pressure boosting liquid partition device being capable of feeding and retracting a large amount of hydraulic fluid under high pressures to and from at least first and second pressure transfer devices, the pressure transfer devices pumping fluids with particles at high volumes and pressures above 500 bars.

The invention may form part of a larger pumping system comprising one or more of a pressure transfer device, a dual acting pressure boosting liquid partition device and a flow regulating assembly (such as a valve manifold).

The invention is suitable for use with high pressures, ranging from above 500 bars, and is especially suitable in hydraulic fracturing of oil/gas wells where difficult to pump fluids with particles such as proppants form part of the fluid. However, the pumping system may also find use in other well applications, such as in drilling operations for pumping drilling fluids and in cementing operations, plug and abandonment, completion or stimulation operations, acidizing or nitrogen circulation.

BACKGROUND OF THE INVENTION

Hydraulic fracturing (also fracking, fracing, fraccing, hydrofracturing or hydrofracking) is a well stimulation technique in which rock is fractured by a pressurized fluid, in the form of gel, foam, sand or water. Chemicals may be added to the water to increase the fluid flow or improve specific properties of the water, such treated water is called 'slickwater'. The process involves the high-pressure injection of 'fracking fluid' (liquid holding sand or other proppants and chemicals) into a wellbore to create cracks in the deep-rock formations through which natural gas, petroleum, and brine will flow more freely. Normally, mechanical piston pumps are used for pumping the fracking fluid under high pressures. These mechanical pumps have very limited operating time due to mechanical wear and tear on the sliding surfaces within the pump caused by the sand and particles in the pumped medium. Pumps operating with particle holding liquids and/or demanding chemical liquids under high pressure have sealing surfaces that the particles and/or abrasive chemical fluids (compounds) damage during operation. When the seals are damaged, there may be leaks and other problems resulting in the pump reduces its effectivity. In addition, the mechanical pumps operate at high speeds, that creates rapid pressure fluctuations through the whole unit (high number of cycles), which after time leads to breakdowns from fatigue. Consequently, the operating life cycle of such pumps are very limited and dependent on particle type, amount of particles, chemical composition and chemical concentration, as well as working pressure. In rotating pumps, the rotary (shaft) seals, and costly pump elements such as impellers and turbine wheels, are quickly worn. In piston pumps, the piston is worn against cylinder resulting in leaks, low efficiency and breakdown. Another well-known problem with plunger pumps is fatigue cracking of the fluid ends. The main cause of this is combined stresses from the pressure fluctuations and mechanical linear stress from the plungers. They are also limited by a maximum allowable rod load on the power end, making it necessary to match plunger size to desired rate/pressure delivery.

In general, plunger/piston pump units are utilized.

When a plurality of pumps are connected to the same flow line down to the well, and are online simultaneously, there is a risk that they form interference patterns that matches the reference frequency of the flow line down to the well. This lead to flow lines that moves around, that can lead to damage of the equipment and personnel (called "snaking" because the flow line moves like a snake).

In fracturing operations, when the pumps are turned off and hydraulic pressure is not longer applied to the well, small grains of hydraulic fracturing proppants hold the fractures open. The proppants are typically made of a solid material such as sand. The sand may be treated sand or synthetics or naturally occurring materials such as ceramics. In onshore fracturing, typically a so-called frack fleet comprising a number of trucks are transported and positioned at location. Each truck is provided with a pumping unit for pumping fracking fluid into the well. Thus, there are weight and physical limitations on the equipment to be used limited by the total weight capacities on the truck on the road and on the physical limitations given by the trucks.

Prior art, not suitable for fracturing but disclosing a system where clean hydraulic fluid is separated from the liquid to be pumped, includes EP 2913525 relating to a hydraulically driven diaphragm pumping machine ("pump"), in particular for water and difficult-to-pump materials. The system comprises at least two side-by-side pumping units. Each pumping unit comprises a pump cylinder and a hydraulic cylinder. The pump cylinder (reference signs relating to EP 2913525, 1,2) has a lower first end with a first inlet and outlet for liquid to be pumped and an upper second end with a second inlet and outlet for hydraulic fluid. The pump cylinder (1,2) contains a bellows (3,4) closed at its lower end and open at its upper end for communication with hydraulic fluid. The outside of the bellows (3,4) defines a space for liquid to be pumped. The bellows (3,4) of the pump cylinder (1,2) is arranged to be driven by hydraulic fluid supplied at its top end, in concertina like expansion and contraction to pump the liquid to be pumped adjacent the lower first end of the pump cylinder (1,2). The hydraulic cylinder (9,10) is placed side-by-side the pump cylinder (1,2). The hydraulic cylinder (9,10) has a lower first end associated with a hydraulic drive and an upper second end containing hydraulic fluid communicating with the upper second end of the pump cylinder (1,2). The hydraulic drive terminates at its upper end with a drive piston (19,20) slidably mounted in the hydraulic cylinder (9,10). The hydraulic drives of the hydraulic cylinders (9,10) of the two pumping units are connected by a hydro-mechanical connection (25,27) designed to advance and retract the pistons (19,20) of each hydraulic cylinder (9,10).

However, the solution in EP 2913525 is not applicable for hydraulic fracturing at high pressures (i.e. over 500 bars) because of the cylindrical pump chamber. The cylinder-shape of the pump chamber will not be able to withstand the high pressures experienced in combination with a high number of cycles when used in hydraulic fracturing. Furthermore, the bellows are polymer, resulting in risk of particles being squeezed between the cylindrical wall and the bellows, with the possibility of damage to the bellows. In addition, there is one hydraulic cylinder connected to each pump cylinder. The hydraulic cylinder is not configured to boost the pressures entering on the lower side of the piston (19, 20) because the effective area is smaller on the lower side of the piston (19, 20) than on the upper side of the piston (19, 20). Furthermore, on polymer bellows on lack the control on the direction of expansion leading to the possibility for the bellows to come in contact with the cylinder wall. This may lead to tearing and proppants being forced in to the base material.

Consequently, the known systems have drawbacks in relation to provide a dual acting pressure boosting liquid partition device which can provide sufficient pressure on the high pressure side of the pump (above 500 bars), and which can operate two pump units, without the risk of ballooning of the pump chambers and possibly leakage across the seals in the dual acting pressure boosting liquid partition device. Ballooning of the shell, i.e. the drive fluid pump housing, may occur as a result of high pressure differences between an inside of the drive fluid pump and the outside of the drive fluid pump. If the pressure inside the drive fluid pump is e.g. 1000 bars and the pressure on the outside of the drive fluid pump is 1 atmospheric pressure (=1.01325 bar=$1.01325\times 10^5$ Pascal) the housing of the drive fluid pump may not be able to withstand such pressures and a ballooning of the chamber may occur (i.e. the volume inside the drive fluid pump may increase) resulting in potential leaks over seals inside the drive fluid pump.

Thus, an objective of the present invention is to solve at least some of the drawbacks in relation to the prior art solutions.

More specific, one of the objectives of the invention is to provide a system for fracking which can operate at pressures up to 1100 bars and above, without risking leak over the seals in the pump.

Hydro-mechanical connections in general have some drawbacks, including:

- can not synchronize with multiple units,
- can not vary ramp up/down depending on pressure and flow (can not offer of a precise control of the pump characteristics),
- can not partial stroke,
- can not compensate for pressure/flow fluctuations in the flow,
- it would never be able to overlap and make a laminar flow,
- it generates a pressure drop over the control valve, that leads to heating of the oil, and loss of efficiency in the range of 5-10%.

There is a problem with the conventional pumps utilized for fracking that the parts in the system can break down after a few hours and has to be repaired. Thus, to provide for redundancy in the system, frack fleets comprising a plurality of back-up pumps is normal. This drives cost both in maintenance and in man hours, as one service man can only operate a few trucks.

All hydraulic systems have a degree of internal leakage of hydraulic fluid, this will also occur in the closed loop hydraulic system over a number of cycles. This leakage will accumulate over a number of cycles, adding or retracting from the closed volume, leading to the bellows contracting or extending too much. Not having control on this, will lead to premature failure of the bellows.

Thus, an objective of the present invention is to solve at least some of the drawbacks in relation to the prior art solutions and more specific to keep moving parts (pistons, seals) away from particle fluid (i.e. pumped medium) and avoid particles damaging moving parts.

More specific, it is an objective of the present invention to provide a smooth and shock-free pumping of large flows at high pressures, reducing wear and tear on all components in the flow loop and at the same time providing a unit that is capable of seamlessly integrate and adapt to any pressure flow rate demand without the need for mechanical rebuild or changes. In addition, the present invention's ability to synchronize with multiple units, minimizes the risk of potential snaking. More specific, one of the objectives of the invention is to provide a system for fracking which can operate at high pressures with high volume flow.

Another objective is to provide a pumping system which has reduced weight, e.g. the pumping system shall be able to be arranged and transported on standard trucks or trailers forming part of so-called frack-fleets used in hydraulic fracturing.

Another objective is to provide a fully stepless controlled bellow speed/stroke control to avoid pressure peaks, flow peaks and fluctuations.

Another objective is to create a pump system for all pressures and flow configurations, normally used in fracturing or other high pressure pumping industries, without the need of a mechanical rebuild.

Another objective of the invention is to provide an advanced control system and synchronization of multiple units, to eliminate the problems with conventional systems.

Another objective is to provide a solution which can be used in new installations and be connected to existing installations, such as retrofitting of existing systems.

SUMMARY OF THE INVENTION

The objectives are solved by the invention as set forth in the independent claims, where detailed embodiments of the invention are defined in the dependent claims.

The present invention provides significant improvements in relation to known solutions The invention relates to a dual acting pressure boosting liquid partition device suitable for operating at extreme pressures, i.e. pressures above 1100 bars.

The dual acting pressure boosting liquid partition device can be used as a pressure intensifier for driving a pressure transfer device which again pressurizes a fluid medium to be pumped. The invention relates to a dual acting pressure boosting liquid partition device for a closed hydraulic loop volume, the dual acting pressure boosting liquid partition device being capable of feeding and retracting a large amount of hydraulic fluid under high pressures to and from at least a first pressure transfer device and second pressure transfer device, the pressure transfer devices pumping fluids with particles at high volumes and pressures above 500 bars, where the dual acting pressure boosting liquid partition device is controllable by a variable flow supply through at least a first drive fluid port and a second drive fluid port, wherein the dual acting pressure boosting liquid partition device comprises:

- a hollow cylinder housing having a longitudinal extension, wherein the cylinder housing comprises at least a first part and a second part having a first transverse cross sectional area (a1) and a third part having a second transverse cross sectional area (a2) of different size than the first transverse cross sectional area (a1),
- a rod,
  - the rod having a cross sectional area corresponding to the first transverse cross sectional area (a1), and wherein a first part of the rod and the first part of the cylinder housing define a first plunger chamber, and a second part of the rod and the second part of the cylinder housing define a second plunger chamber,
  - the rod further comprises a protruding portion having a cross sectional area corresponding to the second transverse cross sectional area (a2), and the protruding portion and the third part of the cylinder housing define a first outer chamber and a second outer chamber, the protruding portion defines a first piston area, and the rod defining a second piston area different from the first piston area, and wherein the first part of the rod, over at least a part of its length, is formed with a first internal recess extending from a first end surface of the rod, wherein the first internal recess is in pressure communication with the first plunger chamber, and the second part of the rod, over at least a part of its length, is formed with a second internal recess extending from a second end surface of the rod, wherein the second internal recess is in pressure communication with the second plunger chamber.

The dual acting pressure boosting liquid partition device may be any device capable of increasing the pressure in a fluid, such as pressure intensifier, booster, amplifier etc.

In contrast to traditional intensifiers or pressure boosters, dual acting pressure boosting liquid partition device according to the present invention preferably has the same volume in the first and second plunger chambers as the volume filling/entering an inner volume of e.g. bellows in the pressure transfer device (ratio 1:1).

The dual acting pressure boosting liquid partition device is a device which is able to separate or divide two chambers from each other, thereby securing a boosting effect. The dual acting pressure boosting liquid partition device can be a dual acting pressure boosting liquid partition fracturing device.

The wall thicknesses of the hollow cylinder housing and the rod are chosen such that the hollow rod expands proportionally with the expansion of the hollow cylinder housing at all pressures keeping the gap between the outer surface of the hollow rod and the inner surface of the cylinder housing substantially constant at all pressures. In other words, ballooning of the hollow rod counteracts for the ballooning of the hollow cylinder housing. Specifically, the first and optional second plunger chamber will be subjected to extreme pressures. All transitions are shaped to avoid stress concentrations. The rod is therefore hollow in order to compensate for ballooning of the hollow cylinder housing 20 during a pressure cycle. Preferably, the ballooning of the hollow rod is proportional or marginally less than the ballooning of hollow cylinder housing to prevent any extrusion-gap between the hollow rod and the hollow cylinder housing to exceed allowable limits. If this gap is too large, there will be leakage over the first and second seals, resulting in uneven volumes of hydraulic fluids in the first and second plunger chambers. The thickness of the hollow cylinder housing and the walls of the hollow rod, i.e. the walls surrounding the first and second recesses are chosen such that they deform similarly/equally in the radial direction, and optional first and second seals provided between the outer surface of the hollow rod and the inner surface of the cylinder housing are also protected ensuring a long service life of first and second seals.

The protruding portion of the rod is of the same shape as the surrounding third part of the hollow cylinder housing, e.g. if the surrounding third part is cylindrical, the protruding portion is also cylindrical, or if the third part is rectangular or polygonal, the protruding portion is rectangular or polygonal.

The rod, including the part of protruding portion is preferably manufactured in one piece.

It is clear that all hydraulic systems have a degree of internal leakage of hydraulic fluid, however, throughout the description and claims the term closed loop hydraulic system has been used for such a "closed" system to distinguish from systems which are not defined by a definite volume.

It is preferably equal volumes in each of the first and second plunger chambers as the volume entering e.g. bellows in the pressure transfer device.

In an aspect, the first drive fluid port may be arranged in the first outer chamber and the second drive fluid port may be arranged in the second outer chamber, and a first plunger port may be arranged in the first plunger chamber and a second plunger port may be arranged in the second plunger chamber.

In aspect, during use of the dual acting pressure boosting liquid partition device, the rod is driven back and forth by allowing in sequence pressurized liquid to flow into the first drive fluid port and out of the second drive fluid port then to be reversed to go in the opposite direction.

In an aspect the first piston area is larger than the second piston areas at a fixed ratio. However, the relative difference between the first and second piston areas may be even larger depending on the specific project. The fixed ratio is equal to the pressure boosting capacity of the dual acting pressure boosting liquid partition device.

In an aspect, the dual acting pressure boosting liquid partition device may comprise a dual acting pressure boosting liquid partition device position sensor for detection of position of the rod. The dual acting pressure boosting liquid partition device position sensor may possibly be in communication with a control system such as an oil management system/oil management system valve.

In an aspect, dual acting pressure boosting the liquid partition may comprise a first seal between the first part and the rod and a second seal between the second part and the rod, wherein the first and second seals are configured to be lubricated, ventilated and cooled by a lubrication system.

In an aspect, the first plunger chamber and the second plunger chamber are part of a closed loop hydraulic system, respectively.

The invention further relates to a system comprising:

a dual acting pressure boosting liquid partition device as described above, a hydraulic pump unit pressurizing the dual acting pressure boosting liquid partition device through a first port and second port, at least two pressure transfer devices in fluid communication with the first plunger port and second plunger port, respectively, the first and second pressure transfer devices being configured to be pressurized and discharged by the dual acting pressure boosting liquid partition device, and depressurized and charged by the dual acting pressure boosting liquid partition device assisted by a slurry/sludge feed pump during charging, a flow regulating assembly comprising an inlet manifold and an outlet manifold, wherein the flow regulating assembly is configured to distribute fluid between the inlet manifold, pressure cavities in the pressure transfer devices and the outlet manifold.

The system can be a fracturing system such as a system used in fracturing operations.

The optional bellows in the first and second pressure transfer devices may be returned to the first position, i.e. the compressed state, by assistance from feeding pressure in the liquid to be pumped fed from a feed pump. The liquid to be pumped, i.e. feed pressure from the feed pump pumping liquid to be pumped, provides pressure assisting in the compression of the bellows to the first position. In this compression phase, the pressure in the liquid to be pumped is equal to the pressure of the hydraulic fluid in the inner volume of the bellows, and the retracting will be a result of the dual acting pressure boosting liquid partition device creating a pressure differential in volume when retracting. When the dual acting pressure boosting liquid partition device retracts, there will be a differential volume that the pumped fluid volume, supplied and pressurized by the feed pump (blender) (i.e. the feed pump is supplying fracturing fluid to the pressure cavity), will compensate for by compressing the bellows. In the extension state, i.e. when the bellows starts extending by pressurized fluid filling the inner volume, the pressure in the hydraulic fluid is equal to the pressure in the liquid to be pumped (i.e. the feed pressure in inlet manifold and or the reservoir of liquid to be pumped). When the pressure in the pressure cavity exceeds the feed pressure a first valve close, and when the pressure exceeds the pressure in the discharge manifold, a second valve will open and the fluid will flow into the well. This compression and extension of the bellows will occur sequentially in the pressure transfer device.

The pressure transfer device may comprise a pressure chamber housing and at least one connection port, the at least one connection port being connectable to a dual acting pressure boosting liquid partition device via fluid communication means, the pressure chamber housing comprises:

- a pressure cavity inside the pressure chamber housing, and at least one first port for inlet and/or outlet of fluid to the pressure cavity,
- a bellows defining an inner volume inside the pressure cavity, and wherein the inner volume is in fluid communication with the connection port, wherein the pressure cavity has a center axis (C) with an axial length (L'; L") defined by the distance between the connection port and the first port and a varying cross sectional area over at least a part of the axial length (L', L"), and wherein the bellows is configured to move in a direction substantially parallel with the center axis (C', C") over a part of the axial length (L', L") of the pressure cavity.

In an aspect of the system, the dual acting pressure boosting liquid partition device may be configured to sequentially pressurize and discharge, and depressurize and charge, the at least two pressure transfer devices, such that one pressure transfer device is pressurized and discharged while the other is de-pressurized and charged, and vice versa. The dual acting pressure boosting liquid partition device is controlled by a variable flow supplied by the hydraulic pump unit. This flow can be controlled in a manner that allows for over-lapping of the pressure transfer devices when four or more are working together. This gives the possibility for pulsation damping and continuous flow. This is one of the advantages compared to common piston pump driven by a crank shaft that has a variable delivery through the complete cycle, which gives sinus curve deliveries.

According to an aspect, the system may comprise four pressure transfer devices and two dual acting pressure boosting liquid partition devices, each of the dual acting pressure boosting liquid partition devices being configured to sequentially pressurize and discharge, and depressurize and charge, two pressure transfer devices, such that two of the pressure transfer devices are pressurized and discharged while the other two pressure transfer devices are de-pressurized and charged, and vice versa.

According to an aspect, the two dual acting pressure boosting liquid partition devices may be configured to be operated individually, such that they can pressurize and discharge, and depressurize and charge, two of the pressure transfer devices synchronously or asynchronously. The two dual acting pressure boosting liquid partition devices are driven asynchronously to enable overlapping, and thereby deliver a pulsation free overall characteristics.

According to an aspect of the system, each of the two pressure transfer devices comprises a bellows and a bellows position sensor monitoring position of the bellows, and a control system adapted to receive monitoring data from the dual acting pressure boosting liquid partition device position sensor and the bellows comparing the position of the rod and the bellows.

In an aspect of the system, the pressure transfer device may comprise a pressure chamber housing and at least one connection port, the at least one connection port being connectable to a dual acting pressure boosting liquid partition device via fluid communication means, the pressure chamber housing comprises:

- a pressure cavity inside the pressure chamber housing, and at least a first port for inlet and/or outlet of fluid to the pressure cavity,
- a bellows defining an inner volume inside the pressure cavity, and wherein the inner volume is in fluid communication with the connection port, wherein the pressure cavity has a center axis with an axial length defined by the distance between the connection port and the first port and a varying cross sectional area over at least a part of the axial length, and wherein the bellows is configured to move in a direction substantially parallel with the center axis over a part of the axial length of the pressure cavity. The bellows is preferably radially rigid and axially flexible and is arranged to extend and retract over at least a portion of the pressure cavity length. Thus, the pressure cavity has different transverse cross section, e.g. at least two different cross sections, in its longitudinal direction. Preferably, the transition areas between different transverse cross sections are smooth or continuous (without sharp edges). Such smooth or continuous transition areas prevent sedimentation and allows higher pressures without weak points in the pressure cavity. I.e. the forces applied to the pressure cavity comes as a result of the internal pressure. The geometry is optimized to make these forces as uniform as possible.

The connection port is thus adapted for suction of hydraulic fluid and/or expelling pressurized hydraulic fluid into and out of the pressure cavity.

The first port is adapted for inlet/outlet of liquid to be pumped into and discharged out of the pressure cavity.

According to an aspect, the bellows may be connected to an inner surface of the pressure cavity. Preferable, the bellows is connected in an upper part of the pressure cavity with means providing fluid-tight connection between the bellows and the inner surface of the pressure cavity. As such, fluids are prevented from flowing from an inner volume of the bellows and in to the pressure cavity.

The bellows has a shape adapted to the shape of the pressure cavity such that the bellows, in all operational positions thereof, is restricted from coming into contact with an internal surface of the pressure chamber housing. This means that the bellows, in all operational positions thereof, has a maximum extension in the axial and radial direction which is less than the restrictions defined by the inner surface of the pressure chamber housing.

The invention further relates to a fleet comprising at least two trailers, each trailer comprising at least one system as described above.

The invention further relates to use of a dual acting pressure boosting liquid partition device as described above, a system as described above, or a fleet as described above in hydrocarbon extraction or production.

The invention further relates to use of a dual acting pressure boosting liquid partition device as described above, a system as described above a fleet as described above in hydraulic fracturing operations.

The invention further relates to use of a dual acting pressure boosting liquid partition device as described above, the system as described above or a fleet as described above in any one of the following operations: plug and abandonment, well drilling, completion or stimulation operations, cementing, acidizing, nitrogen circulation.

The present invention provides significant improvements in relation to known solutions. The pumping system and associated components thereof, provides for the possibility of pumping at pressures up to 1500 bars and above with high volume flow. For example, the design provides for the possibility of pumping 1 m3 @ 1000 bar pressure per minute or, 2 m3 @ 500 bar per minute, and any rate to pressure ratio between. The invention provides for flexibility with regard to desired pump rates and pump pressures, e.g. reduced flow rates at high pressures and high flow rates at reduced pressures, in all embodiments with a substantially laminar flow.

A pumping system where the system in accordance with the present invention may be used, may comprise one or more of a pressure transfer device, a dual action pressure boosting liquid partition device and a flow regulating assembly (such as a valve manifold). A hydraulic pump unit typically pressurizes the dual acting pressure boosting liquid partition device, wherein the dual acting pressure boosting liquid partition device pressurizes the pressure transfer device. The optional bellows in the pressure transfer device functions as a "piston" between the hydraulic pressure side, i.e. the dual acting pressure boosting liquid partition device and the hydraulic pump unit on one side, and the medium to be pumped into a well on the other side. The bellows functions as an extension of the piston (rod) in the dual acting pressure boosting liquid partition device. The bellows in the pressure transfer device separates the clean hydraulic fluid (inside the bellows) from the dirty fluid with particles (outside the bellows).

The bellows are normally a fluid-tight barrier separating inner volume of the bellows and the volume between the outside of the bellows and the inside of a pressure cavity in the pressure transfer device. I.e. the bellows has a fixed outer diameter but is axial flexible, providing an annular gap (size of gap e.g. at least corresponding to the particle diameter of particles in fracturing fluid) between the internal surface of the pressure chamber housing and the bellows in all positions of the bellows and at all pressures. The bellows is preferably fixedly connected in the top of the pressure cavity, and the bellows is surrounded by the pressure cavity in all directions, i.e. below, radially and possibly partly on an upper side thereof of the parts not forming part of the connection port to hydraulic fluid entering and exiting the inner volume of the bellows. The total pressure cavity volume is constant whereas the inner volume of the bellows is changed. As the bellows extends and retracts inside the pressure cavity, the available remaining volume of the pressure cavity is changed. A hydraulic fluid volume enters the inside of the bellows and displaces the volume of the fluid to be pumped from the pressure cavity.

The pumping system may be a positive displacement pump where variations in volume in the pressure transfer device is achieved using a fluid-tight bellows which is radially rigid and axially flexible. This setup results in a bellows which moves substantially in the axial direction, whereas movements in the radial direction is prohibited or limited. When the bellows is in a first position, i.e. a compressed state, the remaining volume in the pressure cavity is largest, whereas when the bellows is in a second position, i.e. an extended state, the remaining volume in the pressure cavity is smallest. The ratio of dimensions of the inner surface of the pressure cavity and the outer surface of the bellows are designed such that there is formed a gap between the inner surface of the pressure cavity and the outer surface of the bellows in all positions of the bellows, thereby preventing particles being stuck between the inner surface of the pressure cavity and the bellows. Thus, the fracturing fluids surrounds the bellows and the gap is formed such that its minimum extension is larger than the largest particle size of the proppants. The radial rigidity of the bellows ensures that the bellows do not come into contact with the internal surface of the pressure chamber housing. Hydraulic fluid entering the inner volume of the bellows through the connection port pressurizes the barrier, and due to the rigid properties of the bellows and/or the possible internal guiding, all movement of the bellows is in the axial direction. The liquid to be pumped, e.g. fracking fluid, is pressurized by filling the inner volume of the bellows with hydraulic fluid thereby increasing the displaced volume of the bellows, which results in reduced remaining volume in the pressure cavity outside the bellows, and an increase in the pressure of the liquid to be pumped. The liquid to be pumped is then exiting through the first port and further out through a flow regulating assembly such as a valve manifold.

The dual acting pressure boosting liquid partition device does not have any sliding surfaces in contact with the liquid to be pumped. Thus, the lifetime of the parts is prolonged because there are none vulnerable parts in sliding contact with any abrasive liquid to be pumped. Neither does the pressure transfer device have any sliding surfaces in contact with the liquid to be pumped. The pressure transfer device is preferably pressure compensated such that the driving hydraulic pressure is the same as the pressure in the liquid to be pumped, i.e. the fracturing fluid, and, as such, the bellows does not have to withstand the differential pressure between the inner hydraulic driving pressure and the pressure in the liquid to be pumped.

The pressure cavity in the pressure transfer device can taper towards the first port, thus creating a natural funnel where the sediments/proppants/sand may exit together with the fluid. Consequently, the first port of the pressure chamber housing is preferably shaped to prevent sedimentation build-up (proppants/sand etc.) by sloping the pressure cavity towards the first port. The first port may thus preferably be arranged in a lower section of the pressure cavity such that sediments may exit through the first port by means of gravity.

The pressure cavity can be elongated, egg-shaped, elliptical, circular, spherical, ball-shaped or oval, or multi-bubbled (e.g. as the Michelin man) or has two parallel sides and at least a portion of smaller cross section than the cross section in the parallel portion.

The bellows in the pressure transfer device can have a smaller radial and axial extension than an inner surface of the pressure chamber housing (i.e. defining the radial and axial extension of the pressure cavity), thereby forming a gap between an outer circumference of the bellows and an inner circumference, i.e. the inner surface, of the pressure chamber housing in all operational positions of the bellows.

Thus, at all pressures, fluid is surrounding at least two sides of the bellows during operation of the pressure transfer device.

The bellows can have a cylindrical shape or concertina shape. The bellows cylinder construction provides minimal bellows loads since all its surface is constantly in a hydraulically balanced state. The bellows may thus comprise a concertina-like sidewall providing the axial flexibility and a fluid tight end cover connected to the sidewall of the bellows. The concertina-like sidewall may thus comprise a plurality of circular folds or convolutions provided in a neighboring relationship. Neighboring folds or convolutions may e.g. be welded together or connected to each other using other suitable fastenings means such as glue, mechanical connections. The neighboring folds or convolutions may be formed such that particles in the fracturing fluid are prohibited from being trapped between neighboring folds or convolutions in the bellows during retracting and extracting of the bellows. This may be achieved by making the operational range of the bellows, i.e. the predefined maximum extension and retraction of the bellows, such that the openings between neighboring folds or between the folds and the inner surface of the pressure cavity are always larger than the largest expected particle size. As such, the risk of trapped particles are minimized.

The bellows is preferably made of a sufficiently rigid material: metal, composite, hard plastic, ceramics, or combinations thereof etc. providing for a fluid-tight bellows, which is radially rigid and axially flexible. The bellows preferably moves substantially in the axial direction, whereas movements in the radial direction is prohibited or limited. The material of the bellows is chosen to withstand large pressure variations and chemicals in the fluid to be pumped, thus minimizing fatigue and risk of damage. If the bellows is made of metal, it can be used under higher temperatures than bellows which are made of more temperature sensitive materials (i.e. materials which can not operate under higher temperatures).

It is clear that other parts forming part of the overall system may also be made of appropriate materials dependent on the demands in the specific projects, such as metal (iron, steel, special steel or examples above). However, other materials may also be used, such as composite, hard plastic, ceramics, or alternatively combinations of metal, composite, hard plastic, ceramics.

The bellows may comprise a guiding system coinciding with, or being parallel to, a center axis of the pressure cavity, and wherein the bellows expands and retracts axially in a longitudinal direction along the center axis. In an aspect, the guiding system may comprise a guide.

The bellows may comprise a guiding system which comprises a guide. The guide can be connected to a lower part of the bellows and may be configured to be guided in the pressure chamber housing. The guide in the pressure chamber housing can then form part of the inlet and outlet for hydraulic fluid into and out of the inner volume of the bellows. The guide may be coinciding with, or being parallel to, a center axis of the pressure cavity, and the bellows may expand and retract axially in a longitudinal direction along the center axis.

The pressure transfer device may further comprise a bellows position sensor monitoring position of the bellows and or a temperature sensor monitoring the temperature of a drive fluid in the closed hydraulic loop volume. In addition, pressure sensors may be used. The bellows position sensor may be a linear position sensor. The bellows position sensor may be arranged in the connection port and comprise axial through-going openings for unrestricted flow of fluid.

The bellows position sensor may be a linear sensor, a reading device may be fixedly connected to the bellows position sensor and a magnet may be fixedly connected to the guide, and wherein the reading device may be an inductive sensor which can read the position of the magnet such that the bellows position sensor can monitor a relative position of the magnet inductively, and thereby the bellows.

The inductive sensor can be an inductive rod adapted to read the position of a magnet, and thereby the bellows.

The bellows position sensor may comprise an inductive rod adapted to read the position of a magnet attached to the guide, in order for the bellows position sensor to monitor the relative position of the magnet inductively, and thereby the bellows.

The system may further comprise a control system for controlling working range of a pump bellows and the rod, and be configured to decide whether the bellows and rod operate within a predetermined position operation range defined by maximum limitations such as maximum retracting position and maximum extension position of the bellows, the control system being adapted to compare position by calculate if an amount of hydraulic fluid volume is outside the predetermined position operation range or not and/or by monitoring positions of the bellows and the dual acting pressure boosting liquid partition device and comparing with the predetermined position operation range. The system may have the possibility to operate an oil management system valve to, based on the working range, drain or re-fill hydraulic fluid into the closed hydraulic loop volume to keep the system running within predetermined positions, and not running into failure, thereby increasing the life span of the components in the system.

The control system thus compares the signals from the bellows position sensor and the dual acting pressure boosting liquid partition device position sensor in the dual acting pressure boosting liquid partition device to decide whether the system operates within the predefined working ranges.

In addition, the system may use a control system which, based on input from potential temperature sensor(s), is able to decide when to use the oil management system valve to change (refill, drain) the oil in the closed hydraulic loop system.

The control system also enables partial stroking when working with large proppants, and/or at start-up. This is crucial in situations where the unit has had an unplanned shut down where pumped liquid still is a slurry, allowing proppants to fall out of suspension and sediment. Partial stroking is then applied in order to re-suspend the proppants in to a slurry (suspended).

The predetermined bellows position operating range can be defined by specific physical end positions for the bellows, both for compression and extension of the bellows. Alternatively, instead of physical end positions, the end positions can be software-operated positions indicating the end positions. A signal can then be transferred to the control system, indicating the bellows has reached end position(s). The physical or software-operated positions providing the end positions can be integral parts of the bellows, e.g. as part of a guiding system or a bellows position sensor, or separate from the bellows. The control system can then decide if the bellows has reached its end position. If the bellows does not reach end position, the control system can decide that an (expected) signal is not read, and instruct the oil management system valve to drain or refill hydraulic fluid in the closed hydraulic loop volume.

The volume flowing into and out of the inner volume of the bellows is monitored using the bellows position sensor providing a high accuracy and a controlled acceleration/deceleration of the bellows at the turning point of the dual acting pressure boosting liquid partition device, which again results in calm and soft seating of the valves, i.e. 'ramped down' movement of the valves in the flow regulating system. The slow and controlled movement of the valves prevents or minimize the risk of damaging the valve seats in the flow regulating system. Thus, to achieve this, the system is able to monitor the position of the dual acting pressure boosting liquid partition device using the dual acting pressure boosting liquid partition device position sensor, and when approaching end position, the discharge speed of the unit is ramped down in order to cushion/dampening the speed of the valve element before entering the valve seat.

The dual acting pressure boosting liquid partition device is preferably double acting where a primary side, defined by a first piston area, of the dual acting pressure boosting liquid partition device operates with a pressure difference of 350-400 bars, and on the secondary side, defined by a second piston area, can have a multiple pressure, for example 1050 bars or higher, which will be similar to the pressure that the pressure transfer device, i.e. the bellows and pressure cavity can operate under.

The pressure transfer device can be operated by the hydraulic pump unit, e.g. an over center variable pump which controls the dual acting pressure boosting liquid partition device. The hydraulic pump unit may have two directions of flow and an adjustable displacement volume. The hydraulic pumping unit may be driven e.g. by any motor operable to operate such hydraulic pump units, such as diesel engines or other known motors/engines. However, it is clear that the described hydraulic pump unit can be exchanged with a variety of hydraulic pumps controlled by a proportional control valve for pressurizing the dual acting pressure boosting liquid partition device and pressure cavity.

The pressure transfer device is preferably pressure compensated, meaning that the bellows is hydraulically operated by guiding an amount of oil or other hydraulic liquid into and out of the inner volume of the bellows moving the bellows between a first position, i.e. compressed state, and a second position, i.e. extended state. In operation, there will be the same pressure in the hydraulic fluids in the inner volume of the bellows as in the fracturing fluid (i.e. medium to be pumped) in the pressure cavity outside of the bellows. The liquid or medium to be pumped, e.g. fracturing fluid, being arranged below the bellows and in the gap formed between the outside of the bellows and the inner surface of the pressure chamber housing.

It is further possible to provide a trailer, container or a skid, comprising the dual acting pressure boosting liquid partition device as defined above and/or the system defined above used in hydraulic fracturing together with an engine and necessary garniture.

Throughout the description and claims different wordings has been used for the liquid to be pumped. The term shall be understood as the liquid in the pressure cavity on the outside of the bellows, e.g. the hydraulic fracking fluid, fracturing fluid, fraccing, hydrofracturing or hydrofracking, or mud, stimulation fluid, acid, cement etc.

Intensifiers are available on the market today but these intensifiers are based on difference in area in combination with valves, i.e. a pressure booster pump without volume control. Such intensifiers use a plurality of minor strokes to achieve the desired volume which results in pressure loss and generation of heat, which again reduces the life cycle of the pump. Furthermore, it is not possible to control such known pumps using hydraulic pumps and it would not be able to contribute in the depressurization and charging of the bellows.

These and other characteristics of the invention will be clear from the following description of a preferential form of embodiment, given as a non-restrictive example, with reference to the attached drawings wherein:

DETAILED DESCRIPTION OF A PREFERRED EMBODIMENT

Figure 1:
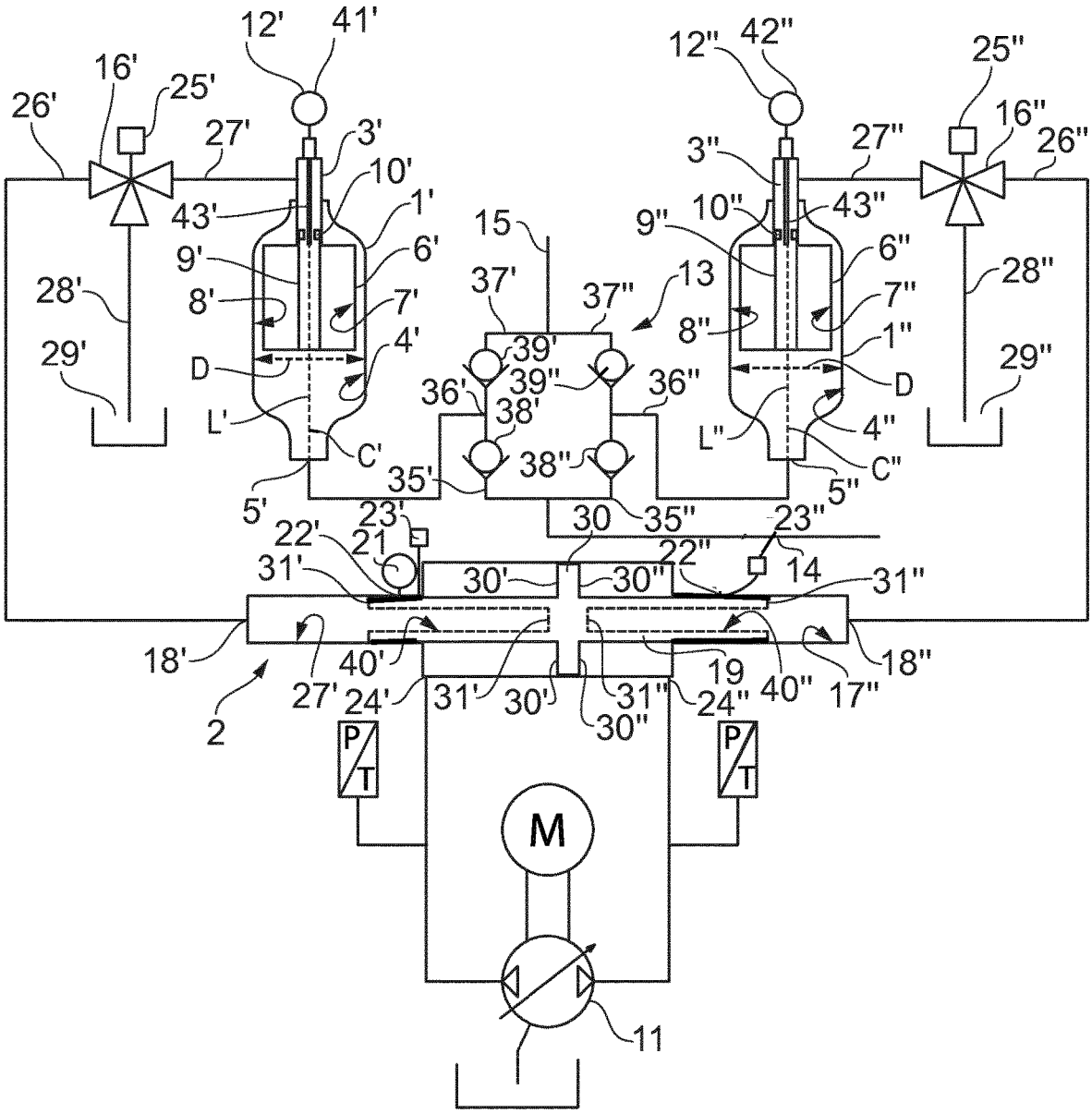
FIG. 1 shows an operational setup of system comprising a dual acting pressure boosting liquid partition device according to the present invention.

FIG. 1 shows an operational setup of system comprising a dual acting pressure boosting liquid partition device according to the present invention.

Figure 2:
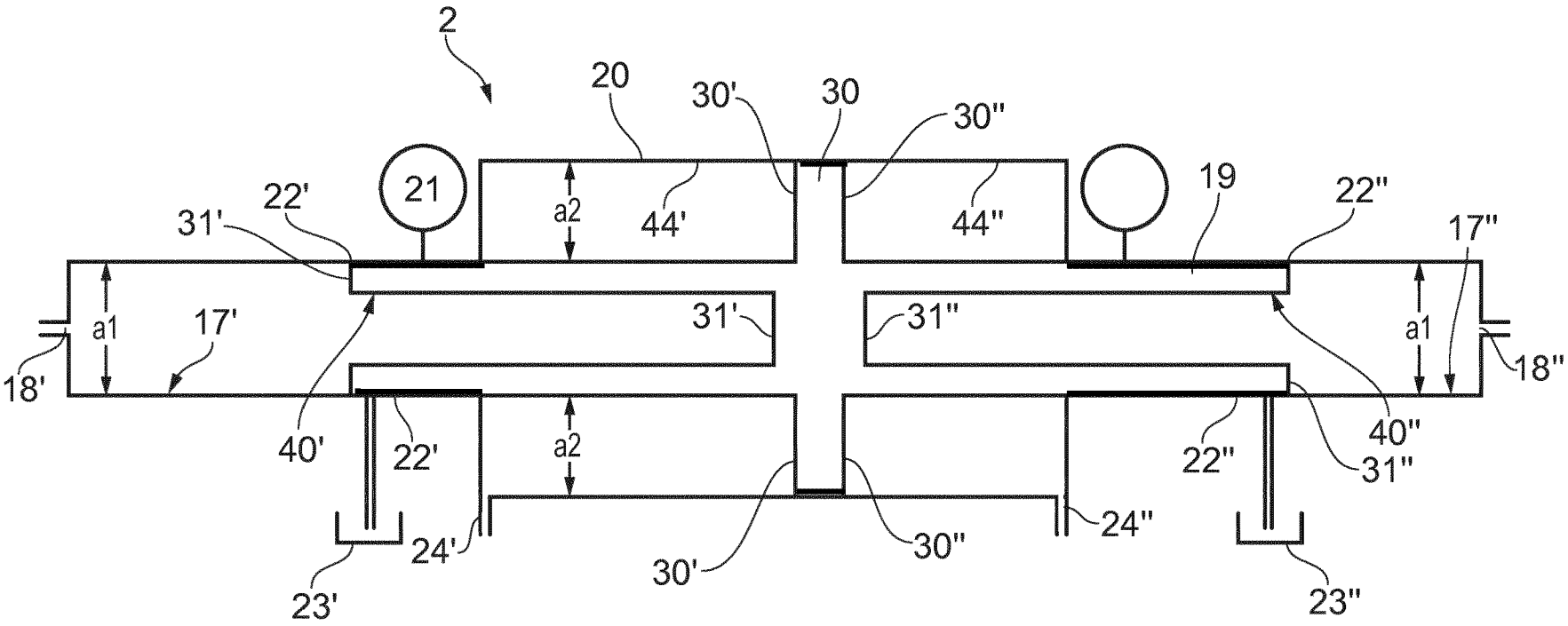
FIG. 2 is an enlarged view of the dual acting pressure boosting liquid partition device according to the invention.

FIG. 2 is an enlarged view of the dual acting pressure boosting liquid partition device.

It is disclosed a well stimulation pressure transfer device specifically designed for very high pressure (500 bar and above) at high rates (e.g. 1000 liters/min or more for the specific system disclosed in FIG. 1) pumping fluids, such as slurries, containing high amounts of abrasive particles. Two identical setups are disclosed in FIG. 1, having a common dual acting pressure boosting liquid partition device 2, where the elements of the setup on the left side is denoted with a single apostrophe (') and the elements in the identical setup on the right side is denoted with double apostrophe (").

Details of the dual acting pressure boosting liquid partition device 2 according to the invention is shown in FIG. 2. It is shown a pressure transfer device 1', 1" for pumping fluid at pressures above 500 bars, the pressure transfer device 1', 1" comprising a pressure chamber housing and a connection port 3', 3", the connection port 3', 3" being connectable to a dual acting pressure boosting liquid partition device 2 via fluid communication means in the form of first valve port 26', 26" and second valve port 27', 27" and possibly via an oil management system valve 16', 16". The pressure chamber housing comprises a pressure cavity 4', 4", and a first port 5', 5" connecting the pressure cavity 4', 4" to a well via a flow management system 13. The first port 5', 5" acting as inlet and/or outlet for fluid or liquid to be pumped. It is further disclosed a bellows 6', 6" arranged within the pressure cavity 4', 4", and wherein an inner volume 7', 7" of the bellows 6', 6" is in fluid communication with the connection port 3', 3" and the inner volume 7', 7" is prevented from fluid communicating with the pressure cavity 4', 4". The pressure cavity length L', L", extending in a longitudinal direction between the connection port 3', 3" and the first port 5', 5", has a varying cross sectional area. The bellows 6', 6" is configured to move in a direction substantially in the longitudinal direction, which in the drawing is coinciding with the center axis C', C" of the pressure cavity 1', 1".

The pressure transfer device 1', 1" comprises a bellows, exemplified as a hydraulically driven fluid-tight bellows 6', 6" comprising an internal guide 9', 9" and a bellows position sensor 12', 12" with an inductive rod 43', 43" adapted to read a magnet 10', 10". The magnet 10', 10" may be fixedly connected to the guide 9', 9". The guide 9', 9" is itself guided in the pressure chamber housing, for example along the longitudinal extension of the connection port 3', 3". In the disclosed example, the guide 9', 9" is connected to the lower end of the bellows 6', 6" in one end and is guided in the pressure chamber housing in the upper end thereof. The guide 9', 9", and thereby the magnet 10', 10", follows the movement of the bellows 6', 6". The bellows position sensor 12', 12", e.g. the measuring rod 43', 43" may comprise means for detecting and determining the position of the magnet 10', 10" (and thereby the guide 9', 9" and bellows 6', 6"), for example by inductive detection of the magnet position. Although the description describes that the magnet 10', 10" is connected to the guide 9', 9" which moves relative to the fixed measuring rod 43', 43', it is possible to arrange the magnet 10', 10" stationary and e.g. the guide 9', 9" inductive to monitor the position. Furthermore, it is possible to use other sensors than the linear position sensor described above as long as they are capable of monitor the exact position of the bellows 6', 6".

The bellows 6', 6" is placed in a pressure cavity 4', 4" with a defined clearance to the internal surface of the pressure chamber housing'. The drive fluid is directed into and out of an inner volume 7', 7" of the bellows 6', 6" through a connection port 3', 3" in the top of the pressure cavity 4', 4" (i.e. the top of pressure chamber housing). The bellows 6', 6" is fixedly connected in the top of the pressure cavity 4', 4" to the internal surface of the pressure chamber housing by means known to the skilled person. The connection port 3', 3" is in communication with a dual acting pressure boosting liquid partition device 2 and possibly an oil management system valve 16', 16'.

The pressure transfer device 1', 1" may further comprise an air vent (not shown) to ventilate air from the fluid to be pumped. The air vent may be any vent operable to draw out or ventilate excess air from a closed system, such as any appropriate valves (choke) or similar.

The pumped medium, e.g. fracking fluid with particles, enters and exits the pressure cavity 4', 4" through a first port 5', 5" in the bottom of the pressure cavity 4', 4" (i.e. pressure chamber housing). The first port 5', 5" is in communication with a flow regulating device 13, such as a valve-manifold. The flow regulating device 13 is explained in greater detail below.

Driven by the dual acting pressure boosting liquid partition device 2 the pressure cavity 4', 4", in combination with the bellows 6', 6", is pumping the fluid by retracting and expanding the bellows 6', 6" between its minimum and maximum predefined limitation. Keeping the bellows within this minimum and maximum predefined limitation prolongs the life of the bellows. In order to ensure that the bellows 6', 6" work within its predefined limitation, this movement is monitored by the bellows position sensor 12', 12". Dynamically moving the bellows outside these minimum and maximum predefined limitations, may severely reduce the life time of the bellows. Without this control, the bellows 6', 6" will over time, as a result of internal leakage mainly in the dual acting pressure boosting liquid partition device 2, be over-stressed either by over-extending (will eventually crash with pressure cavity 4', 4" or over compress (retract) causing particles in fluid to deform or puncture the bellows 6', 6" or generate delta pressure). A central guiding system 9', 9", exemplified as a guide 9', 9", ensures that the bellows 6', 6" retract and expand in a linear manner ensuring that the bellows 6', 6" do not hit the sidewalls of the pressure cavity 4', 4" and at the same time ensures accurate positioning readings from the bellows position sensor 12', 12". Thus, the pressure cavity 4', 4" is specifically designed to endure high pressures and cyclic loads at the same time as preventing build-up of sedimentation. The defined distance between the outer part of the bellows 6', 6" and the internal dimension of the pressure chamber housing ensures pressure balance of the internal pressure of the bellows 6', 6" and the pump medium pressure in the pressure cavity 4', 4".

This pressure cavity is designed to carry the cyclic loads that this system will be subjected to, and to house the bellows and the bellows positioning system. The connection port 3', 3" has a machined and honed cylindrical shape through the base material of the pressure cavity 4', 4" "body" and serves as a part of the bellow guiding system 9', 9" like a cylinder and piston configuration. The pressure cavity 4', 4" is ideally shaped to prevent stress concentrations. The internal bellows guiding system 9', 9" ensures a linear movement of the bellows 6', 6" without the need of an external guide.

The first port 5', 5" of the bottom in the pressure cavity 4', 4", is shaped to prevent sedimentation build-up by sloping or tapering the pressure cavity 4', 4" towards the first port 5', 5". Consequently, sedimentation build-up is prevented because the sediments or particles in the liquid to be pumped naturally flows, i.e. by aid of gravity, out of the pressure cavity 4', 4" exiting through the first port 5', 5". Without this sloped or tapered shape, the sedimentation build up may lead to problems during start-up of the pressure transfer device and or the sediments may build-up and eventually surround lower parts of the outside of the bellows 6', 6".

The dual acting pressure boosting liquid partition device 2 comprises a hollow cylinder housing 20 having a longitudinal extension, wherein the cylinder housing comprises a first and second part having a first transverse cross sectional area a1 and a third part having a second transverse cross sectional area a2 of different size than the first and second part. The dual acting pressure boosting liquid partition device 2 comprises a rod 19 movably arranged like a piston inside the cylinder housing 20. The rod 19 has a cross sectional area corresponding to the first transverse cross sectional area a1 and defines a second piston area 31', 31", and wherein the rod 19, when arranged within the hollow cylinder housing 20, defines a first plunger chamber 17' and a second plunger chamber 17" in the first and second part. The rod 19 further comprises a protruding portion 30 having a cross sectional area corresponding to the second transverse cross sectional area a2 and the protruding portion defining a first piston area 30', 30" and a first outer chamber 44' and a second outer chamber 44" in the third part. A part of the rod defining the first and second plunger chamber 17', 17", over at least a part of its length, is formed with a first recess 40' in pressure communication with the first plunger chamber 17' and a second recess 40" in pressure communication with the second plunger chamber 17".

The first plunger chamber 17' comprises a first plunger port 18' that is in communication with the inner volume 7' of the bellows 6', alternatively via the first oil management system valve 16'. Similarly, the second plunger chamber 17" comprises a second plunger port 18" that is in communication with the inner volume 7" of the bellows 6", alternative via the second oil management system valve 16". The volumes inside the first and second plunger chambers 17', 17" are varied with the rod 19 being extracted and retracted in/out of the respective first and second plunger chamber 17', 17". The rod 19 may comprise a dual acting pressure boosting liquid partition device position sensor 21. First and second seals 22', 22" may be arranged between the protruding portion 30 of the rod and the first plunger chamber 17' and the second plunger chamber 17", respectively. Said first and second seals 22', 22" may be ventilated and cooled by a separate or common lubrication system 23', 23".

The rod 19 is driven back and forth by allowing in sequence pressurized fluid, such as oil or other suitable hydraulic fluid, to flow in to first inlet/outlet port 24' and out of second inlet/outlet port 24", then to be reversed to go in the opposite direction. First and second inlet outlet ports 24', 24" are in communication with a hydraulic pump unit 11.

The first and second oil management system valves 16', 16" are positioned between the bellows 6', 6" and the dual acting pressure boosting liquid partition device 2 and are exemplified as two three-way valves which may comprise a first and second actuators 25', 25" operating the first and second three-way valves, respectively. The setups of the first and second oil management system valves 16', 16" and their connection to the different pressure transfer devices 1', 1", are identical. Thus, in the following the system on the left hand side, i.e. the system in communication with the first plunger port 18', will be described in more detail. The oil management system valve 16', in the drawings exemplified as a three-way valve, comprises three ports including a first valve port 26' in communication with first plunger port 18', a second valve port 27' in communication with the connection port 3' of the pressure transfer device, and a third valve port 28' in communication with an oil reservoir 29'. Similarly, with reference to the pressure transfer device 1" on the right hand side, the oil management system valve 16" in communication with the second plunger port 18", comprises three ports including first valve port 26" in communication with second plunger port 18", a second valve port 27" in communication with the connection port 3" of the pressure transfer device 1", and a third valve port 28" in communication with an oil reservoir 29".

The hydraulic pump unit 11 may comprise over center axial piston pumps that are controlled by the position data from both bellows position sensor 12', 12" and dual acting pressure boosting liquid partition device position sensor 21 in the dual acting pressure boosting liquid partition device 2 and possibly according to input data from Human Machine Interface (HMI) and/or the control system. The hydraulic pumping unit 11 may be driven e.g. by a motor M such as any standard motors used in the specific technical fields.

The flow regulating assembly 13, e.g. a valve manifold, may be a common flow regulating assembly for the identical systems on the left hand side and on the right hand side of the Figure. In relation to the system on the left hand side, the flow regulating assembly 13 may comprise a pump port 36' in communication with the first port 5' of the pressure transfer device 1', a supply port 35' in communication with the liquid to be pumped via an inlet manifold 14 in the flow regulating assembly 13, and a discharge port 37' in communication with discharge manifold 15 in the flow regulating assembly 13. To be able to switch and operate between the different inlets and outlets, the flow regulating assembly may comprise supply valve 38' comprising a check valve allowing supply of pump fluid when the pressure in the inlet manifold 14 is larger than the pressure in the pressure cavity 4' and less than the pressure in the discharge valve 39'. The inlet manifold 14 is in communication with a feed pump and blender. The blender mixes the liquid to be pumped, and the feed pump pressurizes the inlet manifold 14 and distributes said mixed fluid to the pressure transfer devices 1', 1" (pressure cavities 4', 4"). The blender typically mixes the liquid to be pumped with particles such as sand and proppants. Such feed pump and blender are known for the person skilled in the art and will not be described in further detail herein.

Similarly, for the system on the right hand side of the Figure, the flow regulating assembly 13 may comprise a pump port 36" in communication with the first port 5" of the pressure transfer device 1", a supply port 35" in communication with the liquid to be pumped via an inlet manifold 14, and a discharge port 37" in communication with discharge manifold 15. Furthermore, to be able to switch and operate between the different inlets and outlets, the flow regulating assembly may comprise supply valve 38" comprising a check valve allowing supply of pump fluid when the pressure in the inlet manifold 14 is larger than the pressure in the pressure cavity 4", and discharge valve 39" allowing fluid to be discharged to the discharge manifold 15 when the pressure in the pressure cavity 4" is higher than the pressure in the discharge manifold 15 for pumping fluids at high pressures and flow rates e.g. into a well.

The flow regulating assembly 13 distributes the pumped liquid between the inlet manifold 14, the pressure cavity 4', 4" and the outlet manifold 15 by utilizing two check valves, one for inlet and one for outlet, and charge/discharge port positioned between them. The supply valve 38', 38" positioned between the supply port 35', 35" and the pump port 36', 36' allowing fluid to charge the pressure cavity 4', 4" when bellows 6', 6" is retracting, i.e. the liquid to be pumped provides pressure from below assisting in the retraction/compression of the bellows 6', 6". The assisting pressure of the liquid to the pressure transfer device in the inlet manifold 14 is typically in the range 3-10 bars refilling the pressure cavity 4', 4" and preparing for next dosage of high pressure medium to be pumped down into the well. When bellows 6', 6" starts extending (i.e. pressurized fluid is filling the inner volume 7', 7" of the bellows 6', 6") the supply valve 38', 38" will close when the pressure exceeds the feed pressure in the inlet manifold 14 and thereby force the discharge valve 39', 39" to open and thereby discharging the content in pressure cavity 4', 4" through the discharge port 37', 37" and in to the discharge manifold 15. This will occur sequentially in the setup on the left hand side of the Figure and on the right hand side of the Figure, respectively.

The hydraulic pump unit 11 utilizes over center axial piston pumps configured in an industrially defined closed hydraulic loop volume, also named swash plate pumps. Swashplate pumps have a rotating cylinder array containing pistons. The pistons are connected to the swash plate via a ball joint and is pushed against the stationary swash plate, which sits at an angle to the cylinder. The pistons suck in fluid during half a revolution and push fluid out during the other half. The greater the slant the further the pump pistons move and the more fluid they transfer. These pumps have a variable displacement and can shift between pressurizing first inlet/outlet port 24' and second inlet/outlet port 24" thereby directly controlling the dual acting pressure boosting liquid partition device(s) 2.

The oil management system valve 16', 16" is exemplified as a three-way valve. However, other setups may be used such as an arrangement of two or more valves. The oil management system valve is controlled by a control system which can determine if correct volume of hydraulic fluid is circulated between the inner volume 7', 7" of the bellows 6', 6" and the first and second plunger chambers 17', 17" by utilizing the position sensors in the bellows and in the dual acting pressure boosting liquid partition device. At the same time, it enables the system to replace the oil in this closed hydraulic loop volume if temperatures in the oil reaches operational limits. This is done by isolating the second valve port 27', 27" from the dual acting pressure boosting liquid partition device and opening communication between first valve port 26', 26" and third valve port 28', 28", thereby allowing the rod 19 in the dual acting pressure boosting liquid partition device 2 to position itself according to the bellows 6', 6" position. The control system controlling the oil management system valve 16', 16" monitors the position of the bellows 6', 6" in co-relation with the position of the plunger 19 and adds or retract oil from the system when the system reaches a maximum deviation limit. It will do this by, preferably automatically, stopping the bellows 6', 6" in a certain position and let the plunger 19 reset to a "bellows position" accordingly. A bellows position of the plunger 19 is typically corresponding to a position where the volumes of the first plunger chamber 17' and the second plunger chamber 17" are the same, which in most situations will be a position where the bellows 6', 6" is in a mid position. Thus, the plunger 19 is preferably positioned relative the actual position of the bellows 6', 6".

The dual acting pressure boosting liquid partition device 2 is for example controllable by a variable flow supply from e.g. hydraulic pump unit 11 through the first inlet/outlet port 24' and second inlet/outlet port 24". The protruding portion 30 comprising a first end (i.e. via first piston area 30') in fluid communication with the first inlet/outlet port 24' and a second end (i.e. via first piston area 30") in fluid communication with the second inlet/outlet port 24". The rod 19 further defines a second piston area 31', 31" smaller than the first piston area 30', 30". The rod 19 separating the first and second plunger chambers 17', 17" and is operated to vary volumes of the first and second plunger chambers 17', 17" by extracting and retracting the rod 19 in/out of the first and second plunger chambers 17', 17", respectively. The rod 19 is a partly hollow and comprises a first recess 40' and a second recess 40". The first and second recesses 40', 40" are separated from each other. Thus, fluid is permitted from flowing between the first and second recesses 40', 40". The first recess 40' is in fluid communication with the first plunger chamber 17' and the second recess 40" is in fluid communication with the second plunger chamber 17'.

The dual acting pressure boosting liquid partition device's 2 function is to ensure that a fixed volume of hydraulic fluid, e.g. oil, is charging/dis-charging the bellows 6', 6". At the same time, it functions as a pressure amplifier (booster or intensifier). In the illustrated dual acting pressure boosting liquid partition device 2 the pressure is increased by having a larger first piston area 30', 30", than the second piston area 31' in the first plunger chamber 17' and second piston area 31" in the second plunger chamber 17", respectively. There is a fixed ratio between the first piston area 30', 30" and the second piston area 31', 31", depending on the difference in the first and second piston areas. Hence, a fixed pressure into the first or second outer chamber 44', 44" gives a fixed pressure amplified by the pressure difference of the first and second piston areas. However, the input pressure may be varied to get a different pressure out, but the ratio is fixed. The amplification of the pressure is vital to enable pumping of fluids well over the maximum normal pressure range of the industrial hydraulic pump units 11 that is powering the unit and is varied to best suited industry needs for pressures.

The dual acting pressure boosting liquid partition device 2 may comprise dual acting pressure boosting liquid partition device position sensor 21 which continuously communicates with the overall control system which can operate the oil management system valve 16', 16" to refill or drain hydraulic fluid from the closed hydraulic loop volume based on input from the dual acting pressure boosting liquid partition device position sensor 21 in the dual acting pressure boosting liquid partition device 2 and in the bellows position sensor 12', 12". In the Figures, the dual acting pressure boosting liquid partition device position sensor 21 is arranged between the rod 19 and inner walls of the first or second plunger chamber 17', 17", such that the dual acting pressure boosting liquid partition device position sensor 21 is able to continuous monitor the position of the rod 19 and transmit signals to a control system comparing the position of the bellows 6', 6" and the piston or rod 19 in the liquid partition device 2. However, it is possible to arrange the dual acting pressure boosting liquid partition device position sensor 21 at other locations as well, including outside the dual acting pressure boosting liquid partition device 2, as long as it can monitor the position of the rod 19. As such, any leakage or overfilling of hydraulic fluid in any of the first or second plunger chambers 17', 17" can be detected and corrected (e.g. by using the oil management system valve 16', 16" to reset the rod to zero deviation position according to bellows position as described above).

Specifically, the first and second plunger chambers 17', 17' will be subjected to extreme pressures. All transitions are shaped to avoid stress concentrations. The rod 19 in the dual acting pressure boosting liquid partition device is preferably a hollow rod in order to compensate for ballooning of the hollow cylinder housing 20 during a pressure cycle. Preferably, the ballooning of the hollow rod 19 is proportional or marginally less than the ballooning of shell to prevent any extrusion-gap between the hollow rod and the shell to exceed allowable limits. If this gap is too large, there will be leakage over the first and second seals 22', 22", resulting in uneven volumes of hydraulic fluids in the first and second plunger chambers 17', 17". The thickness of the shell and the walls of the hollow rod, i.e. the walls surrounding the first and second recesses 40', 40" are chosen such that they deform similarly/equally in the radial direction, and the first and second seals 22', 22" are also protected ensuring a long service life of the first and second seals 22', 22".

The control system has three main functions. The first main function of the control system is controlling the output characteristics of the pressure transfer device 1', 1": the pressure transfer device 1', 1" is able to deliver flow based on of a number of parameters like: flow, pressure, horsepower or combinations of these. Furthermore, if two dual acting pressure boosting liquid partition devices 2 are used, the pressure transfer device 1', 1" can deliver a pulsation free flow up to 50% of maximum theoretical rate by overlapping the two dual acting pressure boosting liquid partition devices 2 in a manner that one is taking over (ramping up to double speed) when the other is reaching its turning position. Thus, it achieved reduced flow rates at high pressures and high flow rates at reduced pressures, in all embodiments with a substantially laminar flow. This is achieved by having an over capacity on the hydraulic pump unit 11. As the rate increases there will be gradually less room for overlapping and thereby an increasing amount of pulsations. The variable displacement hydraulic pump unit 11 in combination with pressure sensors and bellows position sensor 12', 12" and dual acting pressure boosting liquid partition device position sensor 21 is key for the flexibility that the system offers. The control system, which may be computer based, also enables the possibility of multiple parallel pumping systems acting as one by tying them together with a field bus. This may be done by arranging the pumping systems in parallel and use the control system to force or operate the individual pumping systems asynchronous. This minimize the risk of snaking due to interference.

The second main function of the control system is to provide complete control of the bellows 6', 6" movement through the cycles in relation to the dual acting pressure boosting liquid partition device 2. This is of relevance in the closing/seating of the valves in the flow regulating assembly 13 (e.g. supply port 35', 35", pump port 36', 36", discharge port 37', 37", supply valve 38', 38", discharge valve 39', 39") because there is a combination of factors, which needs to work in synchronicity in order for this system to function with these extreme pressures and delivery rates. As for a spring, it is important for the bellows 6', 6" to operate within its design parameters, i.e. not over extending or over compressing in order to have a long service life.

The third main function of the control system is the oil management system valve 16', 16" of the control system which acts when the control system finds a difference between the positions of the dual acting pressure boosting liquid partition device 2 and the bellows 6', 6" or that the temperature is out of predefined limits. The dual acting pressure boosting liquid partition device 2 has in general the same strengths and flaws as a hydraulic cylinder, it is robust and accurate, but it has a degree of internal leakage over the first and second seals 22', 22" that over time will accumulate either as an adding or retracting factor in the closed hydraulic loop volume between the first and second plunger chambers 17', 17" and the inner volume 7', 7" of the bellows 6', 6". To address these issues both the bellows 6', 6" and the dual acting pressure boosting liquid partition device 2 are fitted with position sensors 12', 12", 21 that continuously monitors the position of these units to assure that they are synchronized according to software-programmed philosophy. Over time, the internal leakage of the system will add up, and when the deviation of the position between the bellows 6', 6" and the dual acting pressure boosting liquid partition device 2 reaches the maximum allowed limit, the first and/or second oil management system valves 16', 16" will add or retract the necessary volume to re-synchronize the system (and adjusting preferably automatically in relation to a known position of the bellows 6', 6"). In addition, there may be an issue that the liquid in the closed hydraulic loop volume between the pressure transfer device 1', 1" and the dual acting pressure boosting liquid partition device 2 generates heat through friction by flowing back and forth. On top of that the first and second seals 22', 22" in the dual acting pressure boosting liquid partition device 2 will also produce heat that will dissipate in to the liquid (e.g. oil) in the closed hydraulic loop volume. This issue may be addressed by using the same system as for compensating for internal leakage. The closed loop hydraulic volume can be replaced by the oil management system valve 16', 16". The control system detecting a leak in the hydraulic loop system and thus operates the first and/or second oil management system valve 16', 16" to enable a replacement of the closed hydraulic loop volume by isolating the bellows 6', 6" in a compressed, retracted, position and allowing the dual acting pressure boosting liquid partition device 2 to discharge its volume in to the reservoir (external) and re-charging it with cool oil from the cooling system. For the valves in the flow regulating system 13 (e.g. supply port 35', 35", pump port 36', 36", discharge port 37', 37", supply valve 38', 38", discharge valve 39', 39") to have a long service life it is desirable that the seating of the valves or ports 35', 35", 36', 36", 37', 37", 38', 38" is gentle or soft, i.e. that the valve members are not smashed into their desired valve seats. To achieve this the system monitors the position of the dual acting pressure boosting liquid partition device 2 (i.e. the piston or rod 19 in the dual acting pressure boosting liquid partition device), and when approaching end position, the discharge speed of the hydraulic pump unit 11 is ramped down to cushion the valve before seating to prevent forging of the check valve seat.

For purposes of explanation, systems and configurations were set forth in order to provide a thorough understanding of the system and its workings. However, this description is not intended to be construed in a limiting sense. Various modifications and variations of the illustrative embodiments, as well as other embodiments of the system, which are apparent to persons skilled in the art to which the disclosed subject matter pertains, are deemed to lie within the scope of the present invention.

REFERENCE LIST

| | | |
|---|---|---|
| 1', 1" | 1 | Pressure transfer device |
| 2 | 3.1 | dual acting pressure boosting liquid partition device |
| 3 | 2.2 | Connection port |
| 4', 4" | 2.1 | Pressure cavity |
| 5' | 2.3 | First port |
| 6 | 1.1 | bellows |
| 7 | | Inner volume of bellows |
| 8 | | gap |
| 9', 9" | 1.2 | Guide |
| 10', 10" | | magnet |
| 11 | 7.1 | Hydraulic pump unit |
| 12', 12" | 1.3 | Bellows Position Sensor |
| 13 | 5.1 | Flow regulating assembly |
| 14 | 10.1 | Inlet manifold |
| 15 | 9.1 | Outlet manifold |
| 16' | 4.1 | First oil management system valve |
| 16" | 4.1 | Second oil management system valve |
| 17' | 3.2 | First plunger chamber |
| 17" | 3.2 | Second plunger chamber |
| 18' | 3.3 | First plunger port |
| 18" | 3.3 | Second plunger port |
| 19 | 3.4 | Rod |
| 20 | | Hollow cylinder housing |
| 21 | 3.6 | dual acting pressure boosting liquid partition device position sensor |
| 22' | 3.7 | First seal |
| 22' | 3.7 | Second seal |
| 23 | 6.1 | Lubrication system |
| 24' | 3.8 | First inlet/outlet port |
| 24" | 3.9 | Second inlet/outlet port |
| 25' | 4.3 | First actuator |
| 25" | 4.3 | Second actuator |
| 26' | 4.4 | First valve port |
| 26" | 4.4 | First valve port |
| 27' | 4.5 | Second valve port |
| 27" | 4.5 | Second valve port |
| 28' | 4.6 | Third valve port |
| 28" | 4.6 | Third valve port |
| 29' | 8.1 | Oil reservoir |
| 29" | 8.1 | Oil reservoir |
| 30 | | Protruding portion |
| 30' | | First piston area |
| 30" | | First piston area |
| 31' | | second piston area |
| 31" | | Second piston area |
| 35' | 5.2 | Supply port |
| 35" | 5.2 | Supply port |
| 36' | | Pump port |
| 36" | | Pump port |
| 37' | | Discharge port |
| 37" | | Discharge port |
| 38' | | Supply valve |
| 38" | | Supply valve |
| 39' | | Discharge valve |
| 39" | | Discharge valve |
| 40' | | First recess |
| 40" | | Second recess |
| 42, 42" | | Temperature sensor |
| 43' | | inductive rod |
| 43" | | inductive rod |

-continued

| | |
|---|---|
| 44' | First outer chamber |
| 44" | Second outer chamber |

The invention claimed is:

1. Dual acting pressure boosting liquid partition fracturing device for a closed hydraulic loop volume under high pressures ranging from above 500 bars, the dual acting pressure boosting liquid partition fracturing device being capable of feeding and retracting a large amount of hydraulic fluid under high pressures to and from at least a first pressure transfer device and second pressure transfer device, where the dual acting pressure boosting liquid partition fracturing device is controllable by a variable flow supply through at least a first drive fluid port and a second drive fluid port (24"), wherein the dual acting pressure boosting liquid partition fracturing device comprises:

a hollow cylinder housing having a longitudinal extension, wherein the cylinder housing comprises at least a first part and a second part having a first transverse cross sectional area and a third part having a second transverse cross sectional area of different size than the first transverse cross sectional area, a rod, the rod having a cross sectional area corresponding to the first transverse cross sectional area, and wherein a first part of the rod and the first part of the cylinder housing define a first plunger chamber, and a second part of the rod and the second part of the cylinder housing define a second plunger chamber, wherein a first plunger port is arranged in the first plunger chamber and a second plunger port is arranged in the second plunger chamber, the rod further comprises a protruding portion having a cross sectional area corresponding to the second transverse cross sectional area), and the protruding portion and the third part of the cylinder housing define a first outer chamber and a second outer chamber (44"), wherein the first drive fluid port is arranged in the first outer chamber and the second drive fluid port is arranged in the second outer chamber, the protruding portion defines a first piston area, and the rod defining a second piston area different from the first piston area, wherein the first piston area is larger than the second piston area at a fixed ratio, and wherein the first part of the rod, over at least a part of its length, is formed with a first internal recess extending from a first end surface of the rod, wherein the first internal recess is in pressure communication with the first plunger chamber, and the second part of the rod, over at least a part of its length, is formed with a second internal recess extending from a second end surface of the rod, wherein the second internal recess is in pressure communication with the second plunger chamber, and separate from the first plunger chamber.

2. Dual acting pressure boosting liquid partition fracturing device according to claim 1, wherein, during use, the rod is driven back and forth by allowing in sequence pressurized liquid to flow into the first drive fluid port and out of the second drive fluid port then to be reversed to go in the opposite direction.

3. Dual acting pressure boosting liquid partition fracturing device according to claim 1, comprising a dual acting pressure boosting liquid partition device position sensor for detection of position of the rod.

4. Dual acting pressure boosting liquid partition fracturing device according to claim 1, comprising a first seal between the first part and the rod and a second seal between the second part and the rod, wherein the first and second seals are configured to be lubricated, ventilated and cooled by a lubrication system.

5. Dual acting pressure boosting liquid partition fracturing device according to claim 1, wherein the first plunger chamber and the second plunger chamber are part of a closed loop hydraulic system, respectively.

6. System comprising:

a dual acting pressure boosting liquid partition fracturing device according to claim 1, a hydraulic pump unit pressurizing the dual acting pressure boosting liquid partition fracturing device through first port and second port (24"), at least two pressure transfer devices comprising the first and second pressure transfer devices in fluid communication with the first plunger port and second plunger port, respectively, the first and second pressure transfer devices being configured to be pressurized and discharged by the dual acting pressure boosting liquid partition fracturing device, and depressurized and charged by the dual acting pressure boosting liquid partition fracturing device assisted by a slurry/sludge feed pump during charging, a flow regulating assembly comprising an inlet manifold and an outlet manifold, wherein the flow regulating assembly is configured to distribute fluid between the inlet manifold, pressure cavities in the pressure transfer devices and the outlet manifold.

7. System according to claim 6, wherein the dual acting pressure boosting liquid partition fracturing device is configured to sequentially pressurize and discharge, and depressurize and charge, the at least two pressure transfer devices, such that one pressure transfer device is pressurized and discharged while the other is de-pressurized and charged, and vice versa.

8. System according to claim 6 or 7, wherein the system comprises four pressure transfer devices and two dual acting pressure boosting liquid partition fracturing devices, each of the dual acting pressure boosting liquid partition fracturing devices being configured to sequentially pressurize and discharge, and depressurize and charge, two pressure transfer devices, such that two of the pressure transfer devices are pressurized and discharged while the other two pressure transfer devices are de-pressurized and charged, and vice versa.

9. System according to claim 8, wherein the two dual acting pressure boosting liquid partition fracturing devices are configured to be operated individually, such that they can pressurize and discharge, and depressurize and charge, two of the pressure transfer devices (1', 1") synchronously or asynchronously.

10. System according to claim 6, wherein the two pressure transfer devices comprises a bellows and a bellows position sensor monitoring position of the bellows and a control system adapted to receive monitoring data from the dual acting pressure boosting liquid partition device position sensor and the bellows comparing the position of the rod and the bellows.

11. Fleet comprising at least two trailers, each trailer comprising at least one system according to claim 6.

* * * * *